US007814890B2

(12) United States Patent
Hokkanen et al.

(10) Patent No.: US 7,814,890 B2
(45) Date of Patent: Oct. 19, 2010

(54) INJECTION MEANS FOR A COMBUSTION ENGINE

(75) Inventors: Vesa Hokkanen, Björnlunda (SE); Kim Kylström, Tullinge (SE)

(73) Assignee: Scania CV AB (SE)

( * ) Notice: Subject to any disclaimer, the term of this patent is extended or adjusted under 35 U.S.C. 154(b) by 62 days.

(21) Appl. No.: 12/296,481

(22) PCT Filed: Apr. 4, 2007

(86) PCT No.: PCT/SE2007/000320

§ 371 (c)(1),
(2), (4) Date: Oct. 29, 2008

(87) PCT Pub. No.: WO2007/117193

PCT Pub. Date: Oct. 18, 2007

(65) Prior Publication Data

US 2009/0173316 A1 Jul. 9, 2009

(30) Foreign Application Priority Data

Apr. 10, 2006 (SE) ..... 0600800

(51) Int. Cl.
*F02M 59/46* (2006.01)
*F02M 37/04* (2006.01)

(52) U.S. Cl. ..... 123/506; 123/467

(58) Field of Classification Search ..... 123/457, 123/458, 506, 499, 456, 447, 459, 446, 467
See application file for complete search history.

(56) References Cited

U.S. PATENT DOCUMENTS

| | | | | |
|---|---|---|---|---|
| 6,453,875 | B1 | 9/2002 | Mahr et al. | |
| 6,644,282 | B2 * | 11/2003 | Schwarz | 123/467 |
| 7,007,671 | B2 | 3/2006 | Nakayama et al. | |
| 2003/0116136 | A1 * | 6/2003 | Schwarz | 123/447 |
| 2004/0206335 | A1 * | 10/2004 | Braun et al. | 123/446 |
| 2008/0041977 | A1 * | 2/2008 | Hotta et al. | 239/533.12 |

FOREIGN PATENT DOCUMENTS

| | | |
|---|---|---|
| DE | 102004048322 A1 | 4/2006 |
| WO | WO 2006/051009 | 5/2006 |

OTHER PUBLICATIONS

International Search Report dated Jul. 25, 2007, issued in corresponding international application No. PCT/SE2007/000320.

* cited by examiner

*Primary Examiner*—Mahmoud Gimie
(74) *Attorney, Agent, or Firm*—Ostrolenk Faber LLP

(57) ABSTRACT

An injector for fuel includes a passage for receiving fuel at an above-atmospheric first pressure, a pressure amplifier and an injection valve which is settable in an open position and a closed position. The injection valve includes a piston element, a closing chamber and an opening chamber. To inject fuel, the pressure amplifier generates a higher second fuel pressure in the opening chamber so that the valve element moves towards an open position and fuel is injected. To end injection of fuel, the high pressure in the opening chamber is reduced and the closing chamber is connected to the fuel source at the first pressure so that the valve is moved towards the closed position by a combined force created by the first pressure and the spring.

9 Claims, 3 Drawing Sheets

INJECTION MEANS FOR A COMBUSTION ENGINE

CROSS REFERENCE TO RELATED APPLICATION

The present application is a 35 U.S.C. §§371 national phase conversion of PCT/SE2007/000320, filed 4 Apr. 2007, which claims priority of Swedish Application No. 0600800-7, filed 10 Apr. 2006, incorporated herein by reference. The PCT International Application was published in the English language.

BACKGROUND TO THE INVENTION, AND STATE OF THE ART

The present invention relates to a fuel injector for a combustion engine and to pressure control of the opening an closing of an injector valve.

One way of reducing discharges of emissions from diesel engines is to inject the fuel at a very high pressure. A so-called "Common Rail system" is commonly used for effecting injection at a high pressure in the combustion spaces of a diesel engine. A Common Rail system comprises a high-pressure pump which pumps fuel at a high pressure to an accumulator tank ("Common Rail"). The pressure in the accumulator tank during operation may be within the range 250 to 1600 bar. The fuel in the accumulator tank is intended to be distributed to all the cylinders of the combustion engine. Fuel from the accumulator tank is injected into the combustion spaces of the respective cylinders by electronically controlled injection means. The injection means comprise injection valves which have to be able to open and close very quickly. The injection valves are controlled by an electrical control unit which substantially continuously calculates the amount of fuel to be supplied to the respective cylinders on the basis of information about various engine parameters, e.g. the engine's load and speed.

Another known practice is to provide injection means with a built-in hydraulic servo unit for imparting a further pressure rise to the fuel delivered from an accumulator tank (Common Rail) before it is injected into the combustion engine. Such a very high injection pressure imposes very high strength requirements for the components of the injection means. To enable the high injection pressure to be maintained for the whole injection period, the injection valves need to be able to open and close very quickly. The injection valves are usually so designed that they are moved to an open position by the pressurised fuel against the action of a spring means, and to a closed position by the spring means when the pressure of the pressurised fuel has decreased. To enable the closing process to take place very quickly when the high fuel pressure decreases, a very powerful spring means has to be used. Such spring means may have to be specially made in order to provide the necessary force and have a service life similar to surrounding components which are subject to the high fuel pressure. Injection means for injecting fuel at a very high pressure in a combustion engine are therefore relatively expensive to manufacture.

SUMMARY OF THE INVENTION

The object of the present invention is to provide an injection means for injecting fuel at a very high pressure in a combustion engine, which injection means can provide the high injection pressure for substantially the whole injection period. Another object is to provide an injection means of robust configuration and reliable function so that it will have a long service life while at the same time being relatively inexpensive to manufacture.

The objects indicated above are achieved with the fuel injector disclosed herein. In this case, the injector comprises a passage which, at least during a closing process, connects a pressurised fuel source, which may take the form of an accumulator tank (Common Rail), to a closing chamber of the injection valve. The pressurised fuel thus imparts a force which, together with the force exerted by the spring means, has the effect of causing the injection valve to move towards the closing position. It is thus possible to provide sufficient closing force to enable very rapid closure of the injection valve so that the fuel's high injection pressure can be maintained until substantially such time as the injection valve closes. As the fuel pressure from the fuel source provides a relatively large force, the spring means need only exert a small force in order to achieve the necessary closing force. The spring means may therefore be of relatively uncomplicated construction and be manufactured inexpensively.

According to an embodiment of the present invention, said piston element has at least one duct running through it. This makes it possible to achieve at least a reduced fuel flow between the closing chamber and the opening chamber. When an injection period has ended, the opening chamber has to be refilled with fuel. The purpose of the duct is to provide fuel refilling between injection periods. However, this duct has a considerably smaller cross-sectional area than the outlet apertures of the injection means. Consequently, only a negligible proportion of the fuel will be pushed through the duct from the opening chamber to the closing chamber during the injection process. With advantage, the injection means comprises a valve means adapted to breaking the connection between said passage and the closing chamber when the valve element is in the open state. The fact that the connection between said passage and the closing chamber ceases when the valve element is in the open state allows only a very limited amount of fuel to be led through the duct in the piston during the injection process before the same high pressure is reached in the closing chamber as in the opening chamber.

According to another embodiment of the present invention, the valve element comprises a portion which, in the closed state, is intended to prevent fuel from the opening chamber being led out through an outlet aperture of the injection means, and said portion, in the open position, allows fuel from said opening chamber to spray out through the outlet aperture. The injection valve may take the form of a needle valve which comprises a valve element with an elongate needle-shaped portion. The needle-shaped portion will be so designed that it blocks a relatively narrow passage between the opening chamber and the outlet apertures of the injection means in the closed position but does not block that passage when it moves to the open position.

According to another embodiment of the present invention, said pressure amplifier is adapted to only generating a fuel pressure increase to the second pressure in a high-pressure chamber on occasions when fuel is intended to be injected into the combustion engine by said injection means. The high-pressure chamber may thus contain fuel at a lower pressure between injection processes. Consequently, the components which are in contact with the fuel in the high-pressure chamber will only be subject to the high second fuel pressure for a relatively short time. The stresses on these components may thus be alleviated. With advantage, the pressure amplifier is adapted to generating a fuel pressure increase to the second pressure in a defined space which, in addition to said high-pressure chamber, comprises only the opening chamber, the closing chamber and a passage which continuously connects the high-pressure chamber to the opening chamber. The high fuel pressure can thus be limited to acting within the reasonably small defined region of the injection means. The number of components which are subject to the high pressure will thus clearly be reduced.

According to another embodiment of the present invention, said pressure amplifier has a piston means comprising a first piston which on one side has a surface in contact with a first pressure chamber containing fuel at a first pressure and which on an opposite side is in contact with a control chamber containing fuel at a control pressure, a spring means adapted to exerting a force on the first piston in order to move the piston means to an initial position, and a second piston which on one side has a surface in contact with a high-pressure chamber containing fuel, the surface of the second piston being smaller than the surface of the first piston. When the pressure in the control chamber decreases, it exerts, together with the spring means, a smaller force than the force which the fuel pressure in the first chamber exerts on the piston element. A linear movement is thus imparted to the piston element. As the surface of the second piston is smaller than the surface of the first piston, a fuel pressure many times greater can be created in the high-pressure chamber than in the first pressure chamber. With advantage, the control chamber is connected to a draining passage, and a control valve is arranged in the draining passage to provide a desired control pressure in the control chamber. When the control valve is placed in an open position, the pressure in the control chamber will be substantially the same as in the draining passage. The control pressure in the control chamber will thus be considerably lower than the pressure in the first pressure chamber. The piston means is thus provided with motion which creates said very high pressure in the high-pressure chamber. During the movement of the piston, fuel drains out from the control chamber. With advantage, this fuel is led back, via the draining passage, to a fuel tank.

According to another embodiment of the present invention, the control valve is settable in an open position in which the fuel pressure in the control chamber is substantially equal to the pressure of the surroundings, and in a closed position in which the fuel pressure in the control chamber is substantially equal to the first pressure. The control valve is with advantage a solenoid valve but it is also possible to use other types of valves. When the control valve opens, the control chamber is thereby connected to a draining passage which is with advantage at the pressure of the surroundings. The pressure in the control chamber when the control valve is open will therefore likewise be substantially equal to the pressure of the surroundings. The fuel pressure in the control chamber thus does substantially not counteract the movement of the piston means and the creation of the very high pressure in the high-pressure chamber. When the control valve opens, said very high pressure in the high-pressure chamber and in the opening chamber is thus created. The injection means is thus placed in an open position and fuel is injected into the combustion engine at the high pressure. When the control valve closes, the movement of the piston means ceases, thereby causing the high pressure in the high-pressure chamber and the fuel injection to cease. The first piston may have at least one duct running through it. It is thus possible, via said duct, for fuel to pass from the first pressure chamber to the control chamber in order to replace the amount of fuel drained away during the injection process.

BRIEF DESCRIPTION OF THE DRAWINGS

Preferred embodiments of the invention are described below by way of examples with reference to the attached drawings, in which.

DETAILED DESCRIPTION OF A PREFERRED EMBODIMENT OF THE INVENTION

Figure 1:
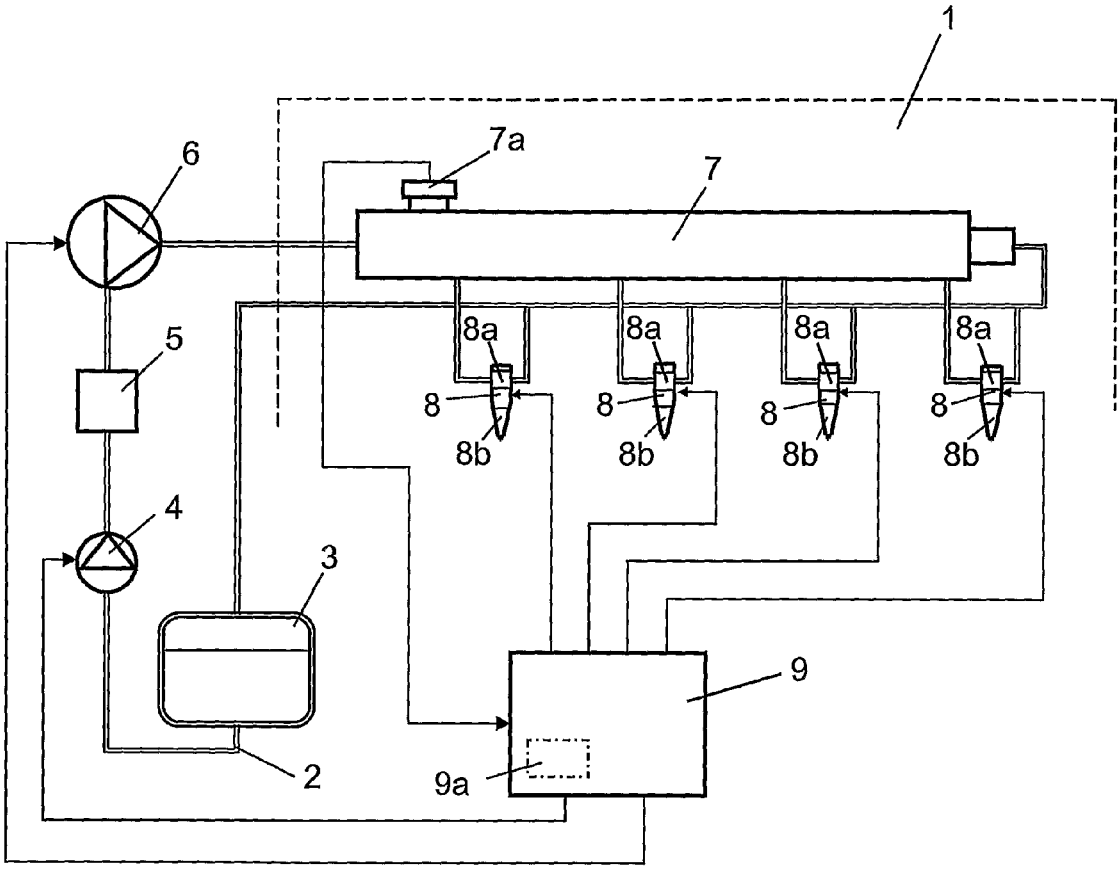
FIG. 1 depicts an injection system with injection means according to the present invention.

FIG. 1 depicts an injection system for injecting fuel at a very high pressure in a combustion engine in the form of a schematically indicated diesel engine 1. Injecting the fuel at a very high pressure reduces discharges of emissions from the diesel engine 1. The injection system and the diesel engine 1 may be fitted in a heavy vehicle. The injection system comprises a fuel line 2 for supplying fuel from a fuel tank 3 to the cylinders of the diesel engine 1. A fuel pump 4 is arranged in the fuel line 2 to transfer fuel from the fuel tank 3 via a filter 5 to a high-pressure pump 6. The high-pressure pump 6 is adapted to pressurising the fuel so that it enters at a high pressure an accumulator tank 7 which takes the form of a so-called Common Rail. Injection means 8 are arranged at each of the connections between the accumulator tank 7 and the respective cylinders of the diesel engine. Each of the injection means 8 comprises a pressure amplifier 8*a* to make it possible to inject fuel via an injection valve 8*b* at a still higher pressure $p_2$ than the pressure $p_1$ which obtains in the accumulator tank 7. An electrical control unit 9 is intended to control the operation of the fuel pump 4, the high-pressure pump 6 and the injection means 8. The electrical control unit 9 may take the form of a computer unit provided with suitable software 9*a* for effecting such control. A pressure sensor 7*a* is fitted in the accumulator tank 7 to detect the pressure therein and send a signal to the control unit 9 conveying information about the pressure values detected.

During operation of the diesel engine 1, the control unit 9 substantially continuously receives control signals concerning engine parameters such as, for example, the engine's load and speed. On the basis of that information, the control unit 9 calculates the amount of fuel which needs to be supplied to the cylinders of the diesel engine 1. The control unit 9 also receives information concerning the momentary pressure $p_1$ in the accumulator tank 7 from the pressure sensor 7*a* and is thereby able to estimate the second pressure $p_2$ through knowing the characteristics of the pressure amplifier 8*a*. On the basis inter alia of this information, the control unit 9 can regulate the injection valves 8*b* so that they open and close at such times that a desired amount of fuel at the second high pressure $p_2$ can be injected into the respective cylinders of the combustion engine 1.

Figure 2:
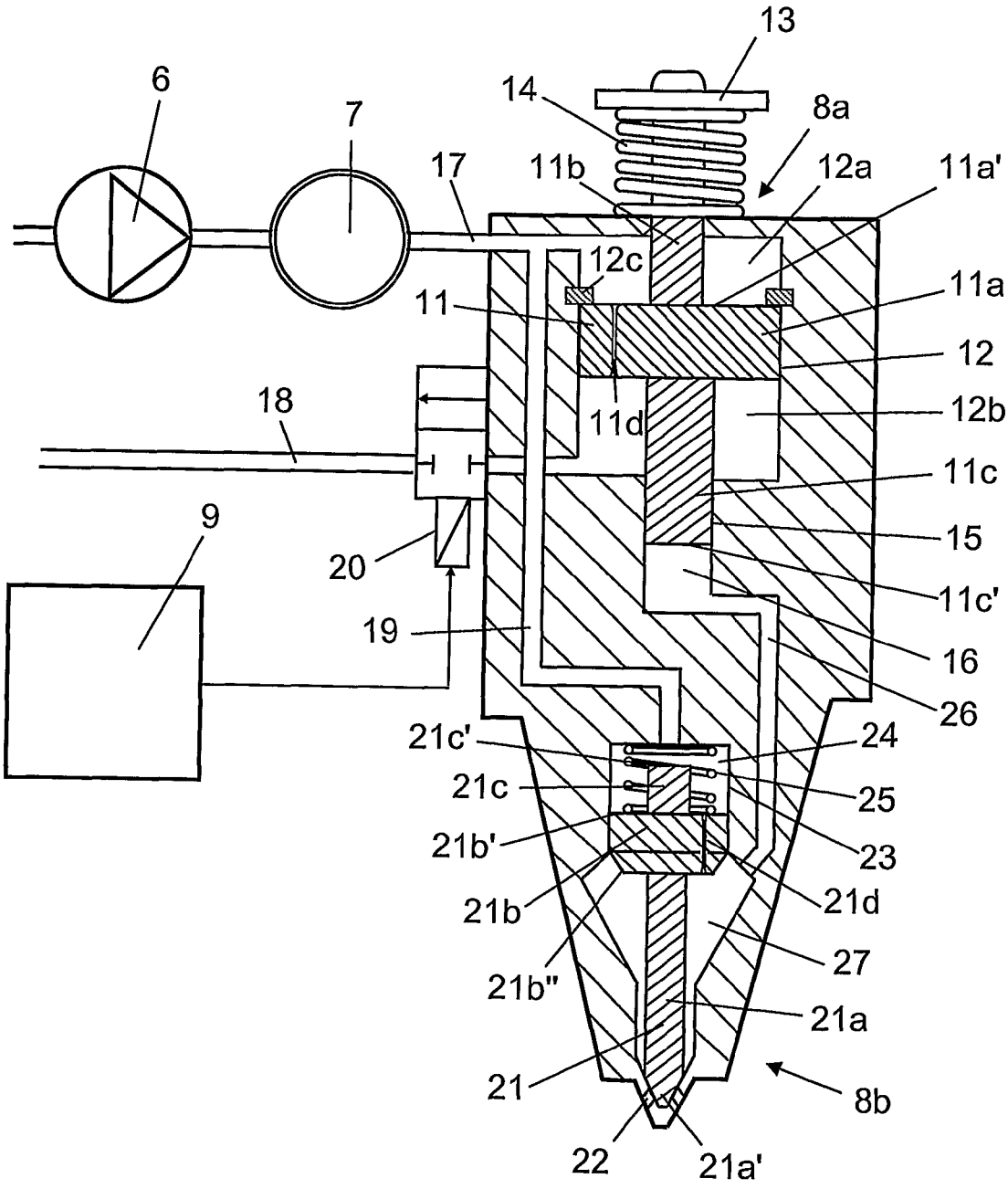
FIG. 2 depicts an injection means according to the present invention at a time when fuel is not being injected into the combustion engine and FIG. 3 depicts the injection means in FIG. 2 at a time when fuel is being injected into the combustion engine.
Figure 3:
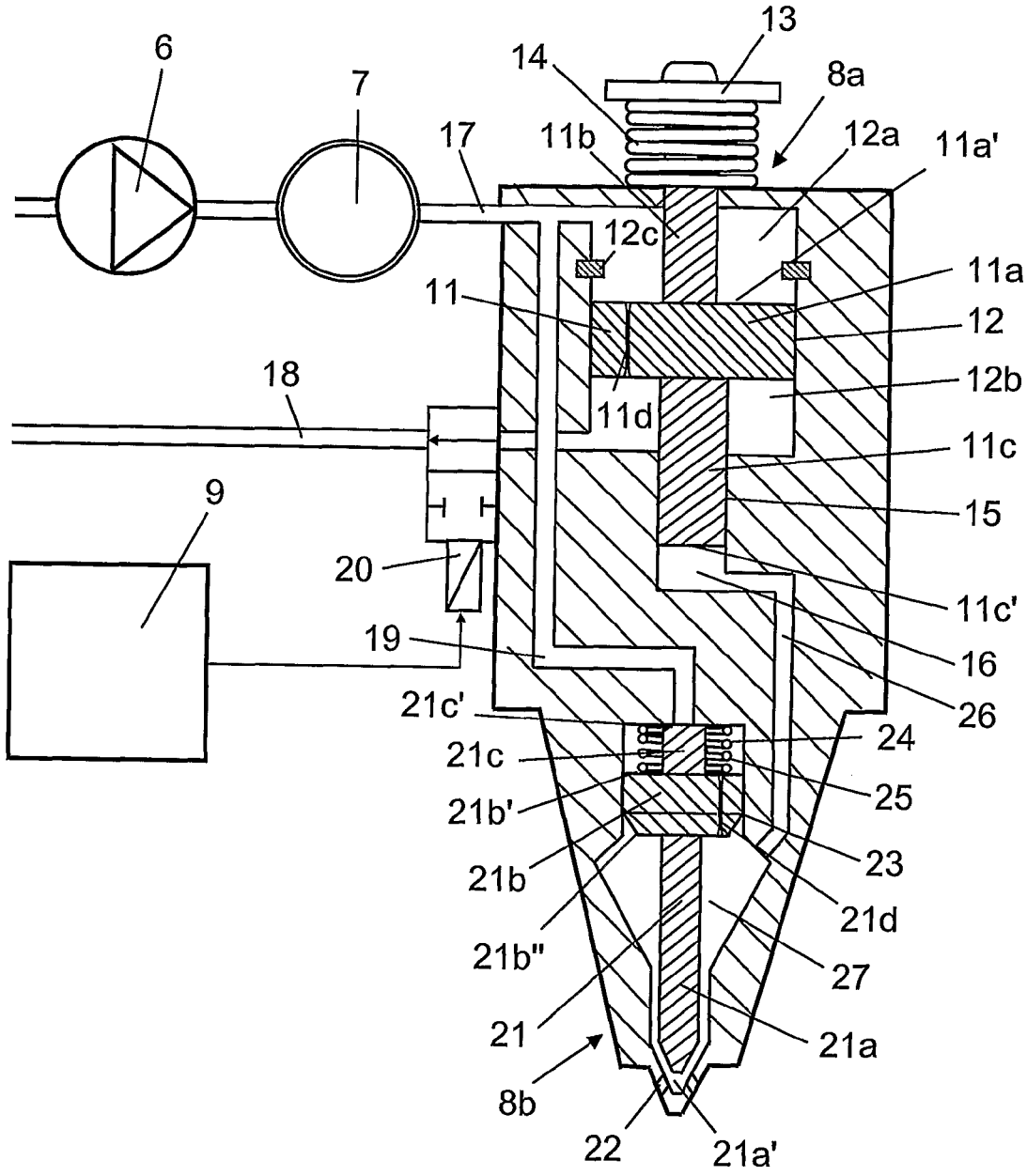

FIGS. 2 and 3 depict the injection means 8 in more detail. The high-pressure pump 6 supplies the accumulator tank 7 with fuel at a first pressure $p_1$. The pressure amplifier 8*a* arranged within the injection means 8 comprises a piston means 11 arranged for linear movement. The piston means 11 comprises a first piston 11*a* adapted to moving in a space 12 so that it divides the space 12 into a pressure chamber 12*a* and a control chamber 12*b*. The first piston 11*a* has a duct 11*d* running through it. The duct 11*d* is of relatively limited cross-sectional area. The duct 11*d* allows a certain flow of fuel between the first pressure chamber 12*a* and the control chamber 12*b*. The piston means 11 has a piston rod 11*b* which extends upwards from the first piston 11*a* and through a hole in a wall of the injection means 8. The piston rod 11*b* has an external end connected to a washer 13. A spring means 14 is clamped between the washer 13 and an external wall surface of the injection means 8 so that the spring means 14 endeavours to move the piston means 11 upwards in the recess 12. The recess 12 comprises a stop means 12*c* which prevents the piston 11*a* from moving past an extreme upper position. The piston means 11 has a portion extending downwards which constitutes a second piston 11*c* arranged for linear movement in a space 15. The second piston 11*c* has a lower surface 11*c*' which together with the surfaces of the space 15 constitutes a high-pressure chamber 16. The pressure chamber 12*a* is in continuous contact, via a passage 17, with the fuel in the accumulator tank 7. The fuel in the pressure chamber 12*a* will therefore be at the same pressure $p_1$ as that in the accumulator tank 7. The control chamber 12*b* is connectable to a draining passage 18 which leads fuel back to the fuel tank 3. A solenoid valve 20 is arranged in the draining passage 18. The control unit 9 is adapted to initiating movement of the solenoid valve 20 to an open position and to a closed position. In the open position, the control chamber 12*b* is connected to the draining passage 18 so that an ambient pressure $p_0$ obtains in the control chamber 12*b*. In the closed position, the connection of the control chamber 12*b* to the draining passage 18 is broken so that the first pressure $p_1$ obtains in the control chamber 12*b*.

The injection means 8 comprises at a lower portion an injection valve 8*b* with a valve element in the form of a needle valve 21. The needle valve 21 comprises an elongate portion 21*a* which has a tapering end 21*a*' with a shape which makes it possible to close outlet apertures 22 of the injection means. The needle valve 21 comprises a piston element 21*b* arranged for linear movement in a space 23. A closing chamber 24 is defined by an upper surface 21*b*' of the piston element and wall surfaces of the space 23. A protruding portion 21*c* extends upwards from the piston element 21*b*. The protruding portion has an upper end surface 21*c*' which constitutes a stop surface for upward movement of the needle valve. When the upper end surface 21*c*' comes into contact with a wall surface of the closing chamber 24, the needle valve 21 has reached its fully open position. The closing chamber 24 communicates via a passage 19 with the fuel in the accumulator tank 7. The function of the upper end surface 21*c*' is to close the outlet aperture of the passage 19 in the closing chamber 24 when the needle valve 21 is in a fully opening position. The upper end surface 21*c*' thus has a larger area than the outlet aperture of the passage 19 in the closing chamber 24 and their mutual positioning is such that said closing function can be effected. The protruding portion 21*c* thus also has the function of constituting a valve means.

A spring means 25 is clamped between the upper end surface 21*b*' of the piston element and an opposite surface in the space 23. The spring means 25 therefore endeavours to move the needle valve 21 downwards in the space 23 towards a closing position. When the needle valve 21 is not in the fully open position, the closing chamber 24 communicates via the passage 19 with the fuel in the accumulator tank 7. In such circumstances the fuel pressure $p_1$ obtains in the closing chamber 24. The piston element 21*b* has a lower surface 21*b*" which constitutes a limiting surface of an opening chamber 27. The opening chamber 27 communicates directly via a passage 26 with the high-pressure chamber 16. The fuel pressure in the opening chamber 27 will therefore always be the same as in the high-pressure chamber 16. The piston element 21*b* has at least one duct 21*d* which allows a certain fuel flow between the opening chamber 27 and the closing chamber 24. The duct 21*d* has a relatively small cross-sectional area. The cross-sectional area of the duct 21*d* is at least considerably smaller than the cross-sectional areas of the outlet apertures 22. When the needle valve 21 is in the fully open position, the closing chamber 24 will therefore not be connected to the fuel in the accumulator tank 7. The fully open position of the needle valve 21 results in a fuel flow through the duct 21*d* until the same high fuel pressure $p_2$ obtains in the closing chamber 24 as in the opening chamber 27. The high fuel pressure $p_2$ in the closing chamber 24, however, will be in contact with a smaller surface of the piston element 21*b* than the high fuel pressure $p_2$ in the opening chamber 27, since the lower $p_1$ acts upon the surface 21*c*' in the closing chamber 24. The spring means 25 has also to be so dimensioned that the needle valve 21 can remain in the fully open position when the high fuel pressure $p_2$ obtains in both the closing chamber 24 and the opening chamber 27.

When no fuel is to be injected into the diesel engine 1, the control unit 9 places the solenoid valve 20 in the closed position, making it impossible for any fuel to be led out from the control chamber 12*b*. The result is the establishment of a fuel pressure $p_1$ in the control chamber 12*b* corresponding to that in the first pressure chamber 12*a*. A certain fuel flow is allowed, however, between the first pressure chamber 12*a* and the control chamber 12*b* via the duct 11*d* extending through the piston 11*a*. This fuel flow makes it possible for the spring means 14 to move the piston 11*a* to the extreme upper position depicted in FIG. 2. This upward movement of the piston means 11 leads to a reduced pressure in the high-pressure chamber 16 and hence in the opening chamber 27. The result in the opening chamber 27 is a lower fuel pressure than the high fuel pressure $p_2$ prevailing in the closing chamber 24 situated on the opposite side of the piston element 21*b*. This pressure difference and the force which the spring means 25 exerts create a force which initially moves the needle valve 21 away from the fully open position. As soon as the needle valve 21 leaves the fully open position, however, the closing chamber 24 is connected to the passage 19 where the fuel pressure $p_1$ obtains. The remaining main part of the needle valve's movement towards the closed position is effected by the force created by the fuel pressure $p_1$ and the spring means 25. When the needle valve 21 reaches the closed position, fuel is prevented from spraying out through the outlet apertures 22. In the closed position, the pressure difference between the closing chamber 24 and the opening chamber 27 is evened out by fuel being allowed to flow through the passage 21*d* extending through the piston element 21*b*. The spring means 25 nevertheless exerts sufficient force to hold the needle valve 21 in the closed position. In the closed position, the first fuel pressure $p_1$ therefore obtains in all the fuel chambers 12*a*, 12*b*, 16, 24, 27 of the injection means 8.

When the control unit 9 estimates that the injection means 8 has to inject fuel, it places the solenoid valve 20 in an open position. The control chamber 12*b* is thus connected to the drainage passage 18 and fuel is led back from the control chamber 12*b* to the fuel tank 3. The pressure in the control chamber 12*b* therefore falls to substantially the pressure prevailing in the fuel tank 3, which is usually the pressure of the surroundings $p_0$. The fuel pressure in the control chamber 12*b* will thus be considerably lower than the fuel pressure $p_1$ in the first pressure chamber 12*a*. This pressure difference results in a force acting upon the piston means 11. This force is clearly greater than the force exerted by the spring means 14. The piston means 11 therefore moves downwards with a relatively large force from the extreme upper position. The second piston's surface 11*c*' which is in contact with the fuel in the high-pressure chamber 16 is considerably smaller than the first piston's surface 11*a*' which is in contact with the fuel in the first pressure chamber 12*a*. When the piston means 11 moves downwards, the result is a considerably higher fuel pressure $p_2$ in the high-pressure chamber 16 than the fuel pressure $p_1$ in the first pressure chamber 12*a*. If the upward force created by the pressure $p_0$ in the control chamber 12*b* and the spring means 14 is negligible relative to the downward force created by the fuel pressure $p_1$ in the first pressure chamber 12*a*, the pressure ratio $p_2/p_1$ will be inversely proportional to the ratio between said piston surfaces 11*a*', 11*c*'. The fuel pressure $p_2$ in the high-pressure chamber 16 may with advantage be at least two to three times greater than the fuel pressure $p_1$ in the first the pressure chamber 12*a*. During the downward movement of the piston means 11, the high fuel pressure $p_2$ in the high-pressure chamber propagates via the passage 26 to the fuel in the opening chamber 27. The high fuel pressure $p_2$ in the opening chamber 27 therefore exerts on the piston element 21*b* an upward force which is considerably greater than the downward force which the fuel pressure $p_1$ in the closing chamber 24 and the spring 25 together exert on the piston element 21*b* of the needle valve 21. The needle valve 21 is thereby moved upwards to an extreme upper position depicted in FIG. 3. The connection between the opening chamber 27 and the outlet apertures 22 opens so that fuel can spray out through the outlet apertures 22 at the high pressure $p_2$. When the needle valve 21 is in the fully open position, the surface 21*c*' breaks the connection between the passage 19 and the closing chamber 24, resulting in the high pressure $p_2$ obtaining both in the closing chamber 24 and in the opening chamber 27.

When the control unit 9 estimates that the desired amount of fuel has been supplied, it closes the solenoid valve 20. The fuel pressure thereupon substantially immediately rises in the control chamber 12*b* to the same pressure level $p_1$ as that in the first pressure chamber 12*a*. The downward movement of the piston 11*a* stops, followed by its turning upwards with the assistance of the force exerted by the spring means 14. The fuel pressure thereupon decreases in the high-pressure chamber 16, the passage 26 and the opening chamber 27. The force which the fuel pressure in the opening chamber 27 exerts on the piston element 21*b* will now be clearly less than the force in the opposite direction which initially the fuel pressure $p_2$ and thereafter the fuel pressure $p_1$ in the closing chamber 24 and the spring means 25 together exert on the piston element 21*b* of the needle valve 21. The needle valve 21 is thereupon moved quickly downwards by the relatively large closing force so that the passage between the opening chamber 27 and the outlet apertures 22 is blocked by the needle valve's lower end 21*a*'. The injection of fuel to the diesel engine from this injection means 8 thereupon ceases quite abruptly. With such powerful and rapid closure of the needle valve 21, the high fuel injection pressure $p_2$ can be maintained for the whole injection period.

With the present injection means 8, fuel can be injected at a very high pressure $p_2$, thereby making it possible to reduce emissions in the exhaust gases. However, the high pressure $p_2$ in the injection means 8 is only created during the fuel injection period. At other times the first fuel pressure $p_1$ obtains in all the fuel chambers 12*a, b*, 16, 24, 27 of the injection means and acts upon their components. In addition, the high fuel pressure $p_2$ is created within a relatively small internal region of the injection means 8, which region comprises the high-pressure chamber 16, the closing chamber 24, the opening chamber 27 and the passage 26 which connects the high-pressure chamber 16 to the opening chamber 27. Thus the high pressure $p_2$ will only come into contact with the lower end surface 11*c*' of the piston means 11 and the surfaces of the needle valve 21 out of the small number of movable components used in the injection means 8 according to the invention. In these circumstances, all that is required for the injection means 8 to have a service life similar to that of a conventional injection means which is subject to a significantly lower fuel injection pressure is that the aforesaid surfaces be of a more robust configuration. The injection means 8 according to the present invention can therefore be manufactured at substantially the same cost as a conventional injection means.

The invention is in no way limited to the embodiment described with reference to the drawings but may be varied freely within the scopes of the claims.

What is claimed is:

1. A fuel injector for injection of fuel at a high pressure in a combustion engine, comprising at least one passage for receiving fuel at a first above-atmospheric pressure from a fuel source;

a pressure amplifier connected with the one passage and operable to generate a fuel pressure increase to a second pressure higher than the first pressure;

an injection valve from the pressure amplifier and comprising a valve element movable between a closed position preventing fuel injection past the valve element and an open position wherein fuel is injected past the valve element to the engine;

a first chamber of the injector, which is divided into a closing chamber and an opening chamber;

a piston element located in and dividing the first chamber, the piston element including a first side in contact with the closing chamber, an opposite second side in contact with the opening chamber, and at least one duct running through the piston element between the closing chamber and the opening chamber, the piston element being connected with the valve element to move the valve element as the piston element is moved;

a first spring operable to exert a force on the piston element in order to move the valve element towards the closed position;

the pressure amplifier being operable to generate, the second fuel pressure in the opening chamber to move the valve element towards the open position for injecting fuel from the injector to the engine;

a passage connecting the closing chamber to the fuel source for at least a substantial portion of the time when the valve element is to move towards the closed position, so that the first pressure and the first spring together provide a force to move the valve element towards the closed position; and an outlet to the engine for fuel from the opening chamber which passes the valve element.

2. An injector according to claim 1, further comprising a second valve operable to break the connection between the passage and the closing chamber when the valve element is in the open position.

3. An injector according to claim 2, wherein the valve element has a portion which in the closed position of the valve element is operable to prevent fuel from the opening chamber being led out through the outlet, and the valve element portion that allows fuel from the opening chamber to exit through the outlet in the valve element open position.

4. An injector according to claim 1, further comprising a high pressure chamber connected with the opening chamber; and the pressure amplifier is operable to generate a fuel pressure increase toward the second fuel pressure in the high-pressure chamber to cause a pressure increase in the opening chamber when fuel is intended to exit the outlet and be injected by the injector.

5. An injector according to claim 4, wherein the pressure amplifier is operable to generate a fuel pressure increase to the second fuel pressure in the high-pressure chamber;

a limited space of the injector includes the high-pressure chamber, the opening chamber, the closing chamber and a passage continuously connecting the high-pressure chamber to the opening chamber.

6. An injector according to claim 5, wherein the pressure amplifier comprises a piston device comprising a second piston, the second piston including one side with a surface in contact with a second pressure chamber containing fuel at the first pressure, and the second piston including an opposite side in contact with a third pressure chamber containing fuel at a control pressure;

a second spring exerting a force on the second piston to move the piston device towards an initial position;

a third piston which has one side with a surface in contact with the high-pressure chamber containing fuel, the third piston's one side surface is smaller than the second piston's one side surface.

7. An injector according to claim 6, wherein the third pressure chamber is connected to a draining passage, and a control valve arranged in the draining passage to provide a desired con trol pressure in the third pressure chamber.

8. An injector according to claim 7, wherein the control valve is settable in an open position in which the fuel pressure in the third pressure chamber is substantially equal to the pressure of the surroundings, or in an open position in which the fuel pressure in the third pressure chamber is substantially equal to the first pressure.

9. An injector according to claim 6, wherein the second piston has at least one duct running through it.

* * * * *